US006779781B2

(12) United States Patent
Bebendorf

(10) Patent No.: US 6,779,781 B2
(45) Date of Patent: Aug. 24, 2004

(54) FENCE POST AND RAIL ASSEMBLY

(76) Inventor: Ronald William Bebendorf, 63 Michelangelo Cr., Mackenzie Qld 4156 (AU)

( * ) Notice: Subject to any disclaimer, the term of this patent is extended or adjusted under 35 U.S.C. 154(b) by 67 days.

(21) Appl. No.: 10/158,520

(22) Filed: May 30, 2002

(65) Prior Publication Data

US 2002/0179895 A1 Dec. 5, 2002

(30) Foreign Application Priority Data

Jun. 5, 2001 (AU) ..... 742277

(51) Int. Cl.[7] ..... E04H 17/14

(52) U.S. Cl. ..... 256/19; 256/24; 256/59; 256/67

(58) Field of Search ..... 256/17, 24, 25, 256/26, 27, 31, 59, 65.01, 65.02, 65.03, 67

(56) References Cited

U.S. PATENT DOCUMENTS

| | | | | |
|---|---|---|---|---|
| 1,070,814 A | * | 8/1913 | Kimball | 5/283 |
| 1,378,948 A | | 4/1921 | Hage | |
| 3,037,593 A | | 6/1962 | Webster | |
| 3,652,060 A | | 3/1972 | Glover | |
| 3,822,053 A | | 7/1974 | Daily | |
| 3,963,219 A | | 6/1976 | D'Amico | |
| 4,133,154 A | | 1/1979 | Ruzicka | |
| 4,148,277 A | | 4/1979 | Engle | |
| 4,188,019 A | | 2/1980 | Meredith | |
| 4,198,034 A | | 4/1980 | Svirklys | |
| 4,723,760 A | * | 2/1988 | O'Sullivan | 256/22 |
| 5,100,107 A | | 3/1992 | Latta | |
| 5,255,897 A | | 10/1993 | Pepper | |
| 5,628,495 A | | 5/1997 | Gandara | |
| 5,639,069 A | | 6/1997 | McClure | |
| 5,702,090 A | | 12/1997 | Edgman | |
| 5,848,502 A | | 12/1998 | Schaefer | |
| 5,988,599 A | | 11/1999 | Forbis | |
| 6,039,307 A | | 3/2000 | De Zen | |
| 6,041,486 A | | 3/2000 | Forbis | |
| 6,345,809 B1 | | 2/2002 | Bebendorf | |

FOREIGN PATENT DOCUMENTS

| | | |
|---|---|---|
| AU | 137015 | 4/1999 |
| AU | 715021 | 5/2000 |
| AU | 142529 | 12/2000 |
| AU | 734491 | 6/2001 |
| AU | 742277 | 12/2001 |

* cited by examiner

*Primary Examiner*—John R. Cottingham
(74) *Attorney, Agent, or Firm*—Rudolf D. Siegesmund

(57) ABSTRACT

The post and rail assembly comprises a post member, rail members, stiffening bars and a plurality of paling members. The rail members connect to the post member, the paling members connect to the rail members. Stiffening bars are entered into said rail member until they straddle one established paling member. Stiffening bars project an equal distance past the sides of the post member. Stiffening bars are adapted to pass through the rail and post members. Stiffening bars are adapted to straddle fence palings and to fill the cavity between the palings and the internal walls of the fence rails.

19 Claims, 5 Drawing Sheets

FENCE POST AND RAIL ASSEMBLY

CLAIM FOR FOREIGN PATENT PRIORITY

This application claims priority benefits from Australian patent No. 742,277 filed on Jun. 5, 2001 and issued Dec. 20, 2001.

FIELD OF THE INVENTION

This invention relates to a method for connecting polyvinyl chloride or metal fence rails to fence posts without the need for separate fasteners. The connecting method is particularly suited to fence rails that are centrally slotted to accommodate fence palings but need not be limited to such.

BACKGROUND OF THE INVENTION

House holders and professional fence builders would recognize that conventional post and rail connecting methods are time consuming and/or lack good aesthetics. An inexpensive, quick and easy, positive connecting method would be desirable to such people. The need for on-site specialized tools would be negated with such a connecting method.

It is the object of the present invention to minimize on site labor costs by providing factory processed detailed connectors for fence posts and rails which, when assembled, will display clean cut lines and strength to completed fence panels.

SUMMARY OF THE INVENTION

The post and rail assembly comprises a post member, three rail members, two stiffening bars and a plurality of paling members. The rail members connect to the post member. The paling members connect to the rail members. The stiffening bars connect to the post and the rail members.

The connection established between the post and rail members is through openings on the inside faces of the post member and the slotted projections at the ends of rail members. The connection between the rail member and paling member is established by dropping the paling members through a plurality of openings in the rail members. The connection between the stiffening bars, post member and rail members is established by inserting stiffening bars through post openings of a completed fence panel. Stiffening bars are entered into the rail member until they straddle one established paling member. Stiffening bars project an equal distance past the sides of the post member.

The post members and rail members, when connected, may be at a right angle with respect to one another. Also the rail members and the paling members, when connected, may be at a right angle with respect to one another. The rail members and the stiffening bars, when connected, may be parallel with respect to one another.

The post member may be used to locate the rail members. Typically the post and rail members are formed as a rectangular hollow section which may be metal or polyvinyl chloride and which may be elongate.

The post members may have a number of openings on the inside faces. Typically there are three openings on each face. The openings can be staggered on each face to accommodate sloping sites. An opening is typically rectangular in shape.

The rail members may have a plurality of openings on one or both edges. The openings may be in alignment. The openings may be rectangular in shape.

At the ends and at the sides and bottom of the rail members may be projections. These projections may be able to engage with the openings on the posts.

The paling members may comprise a pressed hard wood fiber board or polyvinyl chloride board configured to form a rectangular shape when viewed in plane. The paling members may be elongate and adapted to pass through the rail members.

The stiffening bar members may comprise kiln dried dressed hard wood configured to form a rectangular shape when viewed in plane. The stiffening bars may be elongate and can extend from post to post to increase rail strength in exposed terrain. The stiffening bars may be adapted to pass through the rail and the post members. The stiffening bars may be adapted to straddle the fence palings and to fill the cavity between the palings and the internal walls of the fence rails. The stiffening bars would generally be used on the top and center rails only, but would not be limited to such.

BRIEF DESCRIPTION OF THE DRAWINGS

An embodiment of the invention will be illustrated with reference to accompanying drawings in which.

DETAILED DESCRIPTION OF THE PREFERRED EMBODIMENT

Figure 1:
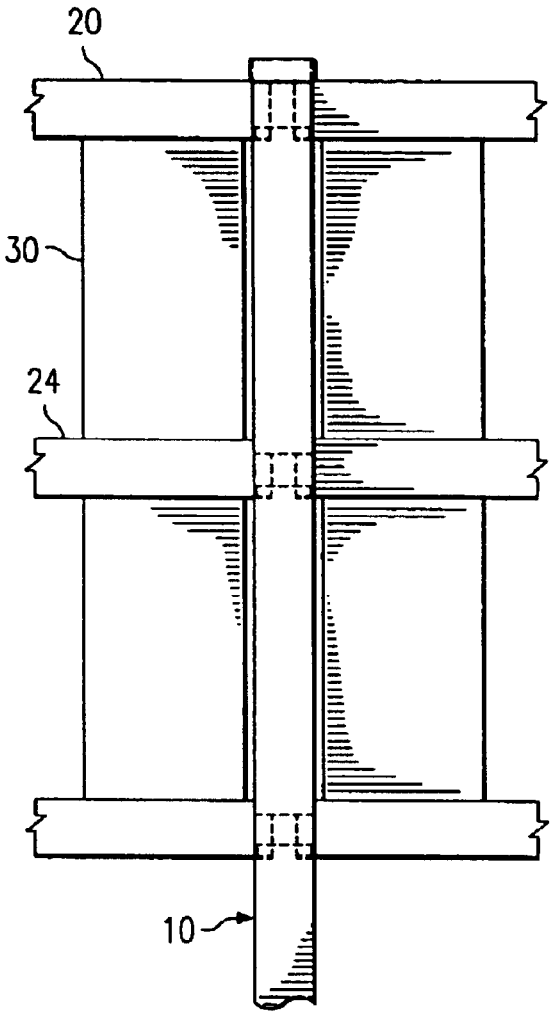
FIG. 1 illustrates a partial front view of a fence post and rail assembly including fence palings according to an embodiment of the invention.

Referring to FIG. 1 there is shown a partial fence assembly comprising a post member 1, rail members 2 and paling members 3.

Figure 2:
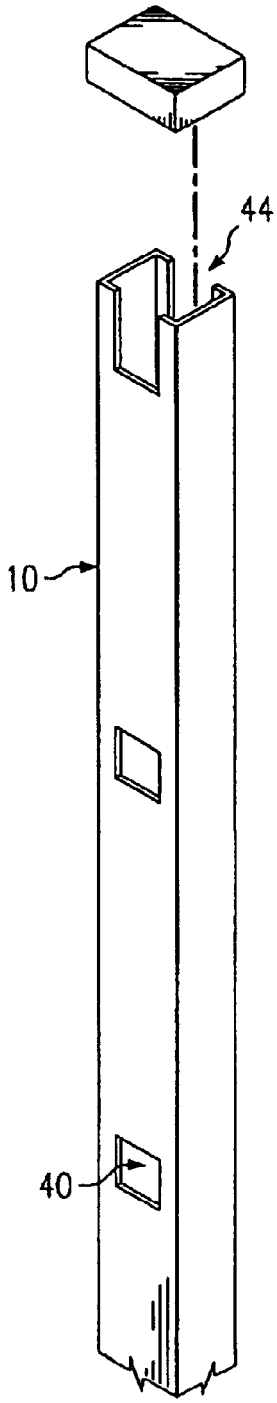
FIG. 2 illustrates a perspective view of the inside of a fence post member according to FIG. 1.
Figure 4:
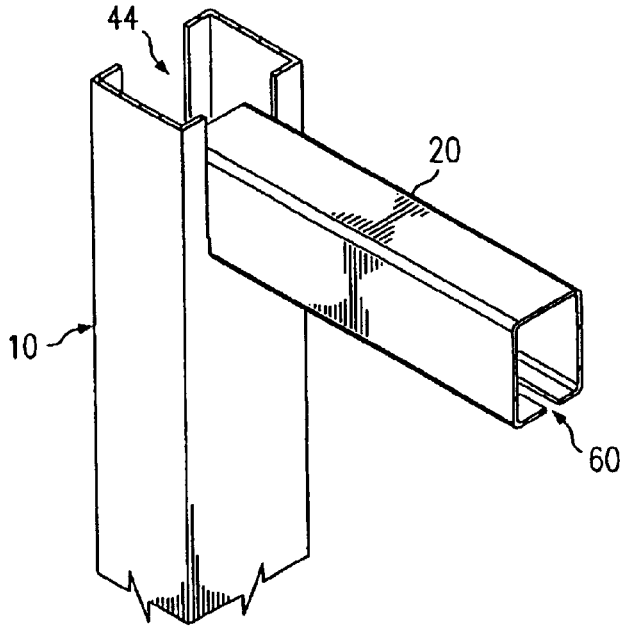
FIG. 4 illustrates a partial perspective view of an assembled post member and top rail member according to FIG. 1 and FIG. 2.

Referring to FIGS. 1, 2, and 4 it can be seen that the post member 1 is formed from a rectangular hollow section and is hollow and elongate. Post member 1 can have three sets of post openings 4 located on the inner walls. Post openings 4 are rectangular in shape. Post openings 4 can be arranged to allow for the stepping of rail members 2 on sloping sites.

Figure 3:
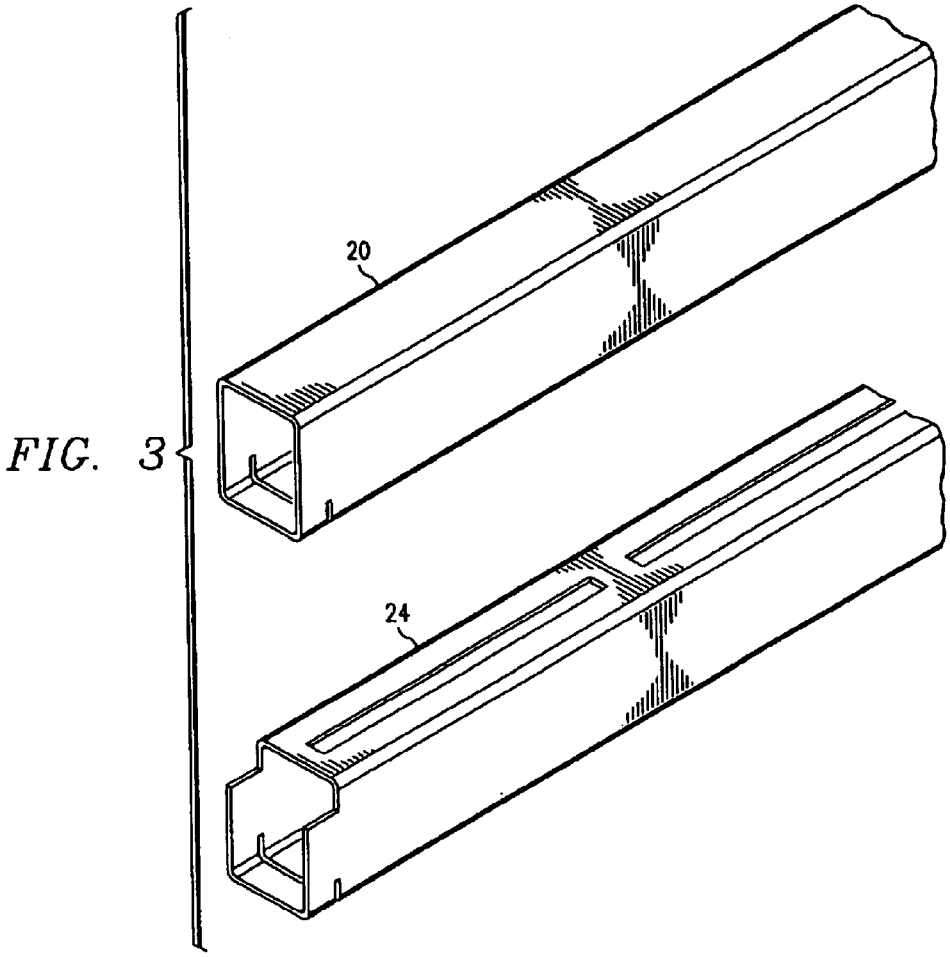
FIG. 3 illustrates a partial perspective view of a mid fence rail member and a top rail member.

Referring to FIGS. 1, 3, and 4 it can be seen that rail member 2 is formed from a rectangular hollow section and is hollow and elongate. Rail member 2 has rail openings 6 located along its length. Rail openings 6 are rectangular in shape and are equally spaced along the length of the edge or edges of rail member 2. Extending along the ends of the side and bottom walls of rail member 2 are hooked shape projections 5. The hooked shape of projections permits rail members 2 to enter into post openings 4 and to lock down into post openings 4.

Figure 5:
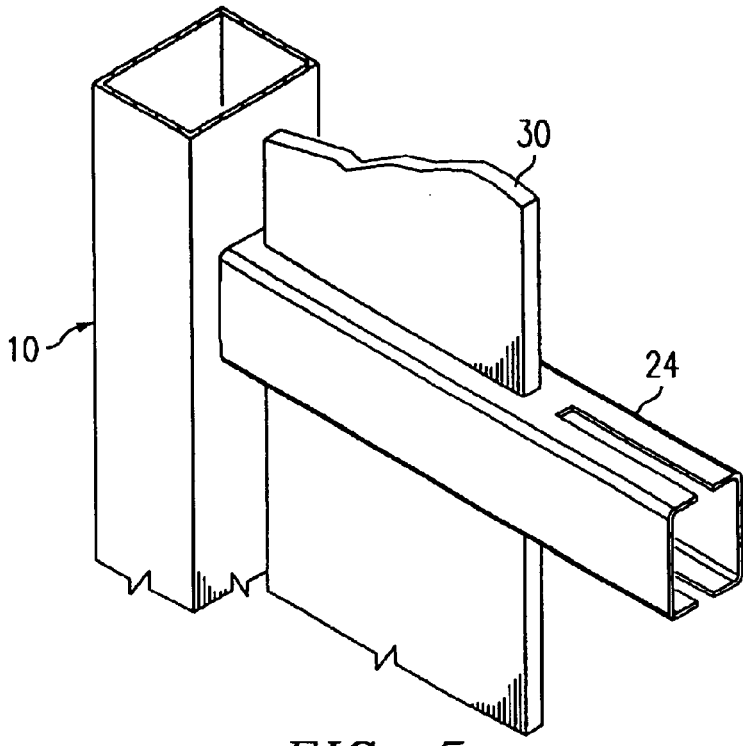
FIG. 5 illustrates a partial perspective view of an assembled post member, mid rail member and paling member according to FIG. 1 and FIG. 4.
Figure 6:
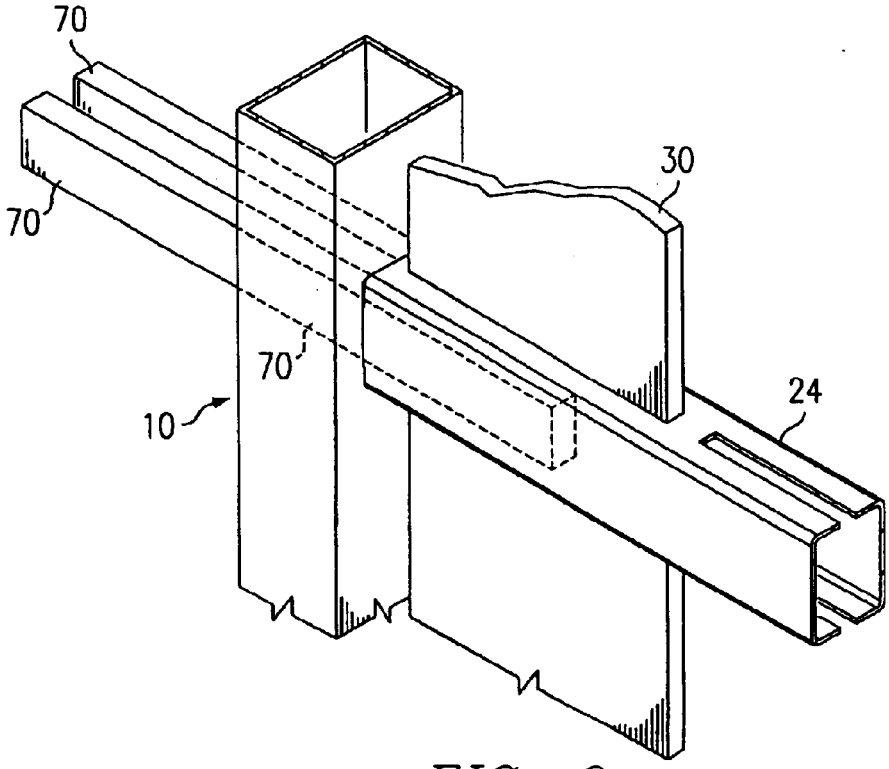
FIG. 6 illustrates a partial perspective view of an assembled post, mid rail member, paling member and stiffener bar members according to FIG. 1 and FIG. 4.
Figure 7:
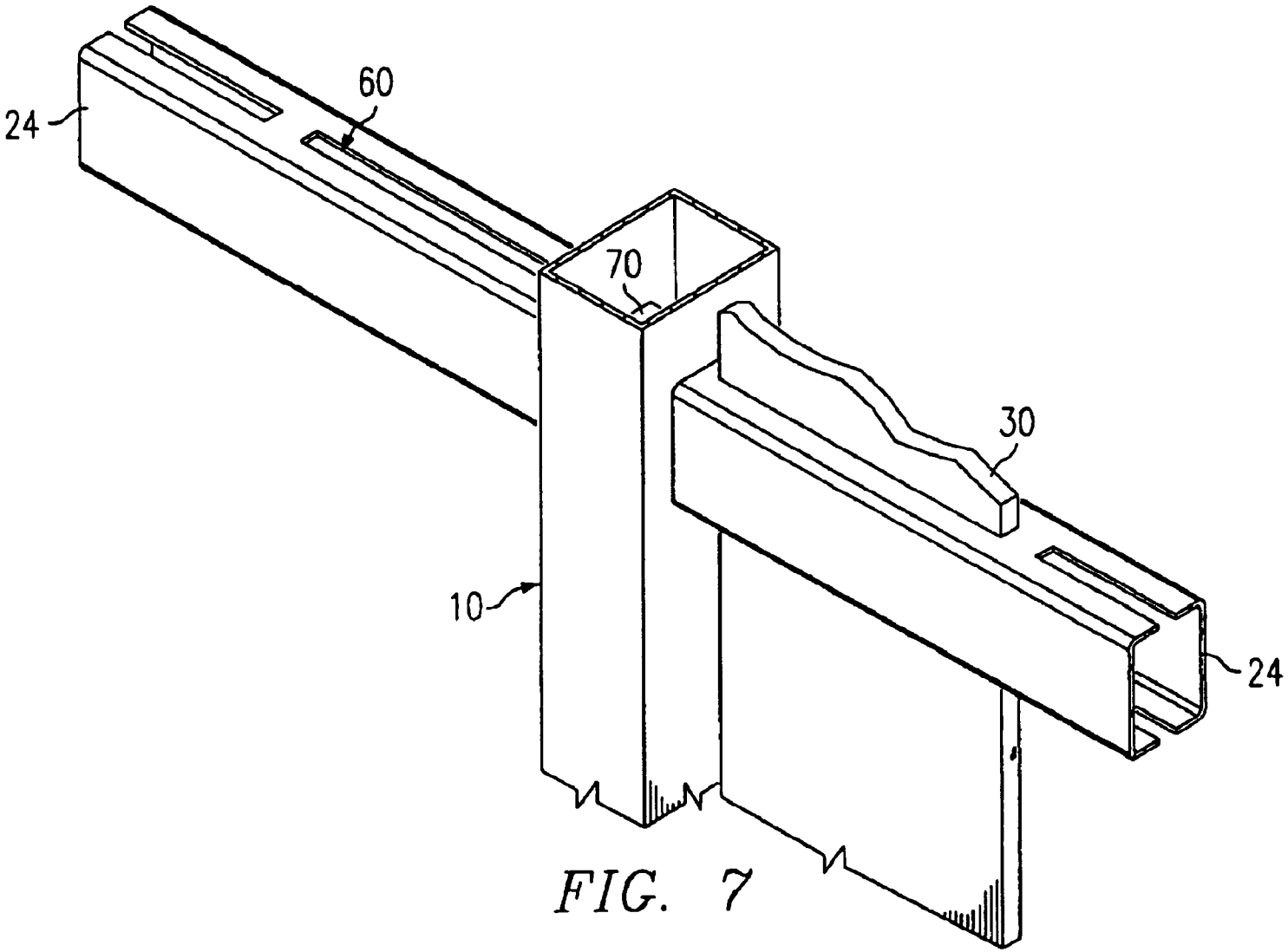
FIG. 7 illustrates a partial perspective view of the fence post member, mid rail member and paling member and rail member inserted over the stiffening bars and locked down into the post member according to FIG. 1 and FIG. 6.
Figure 8:
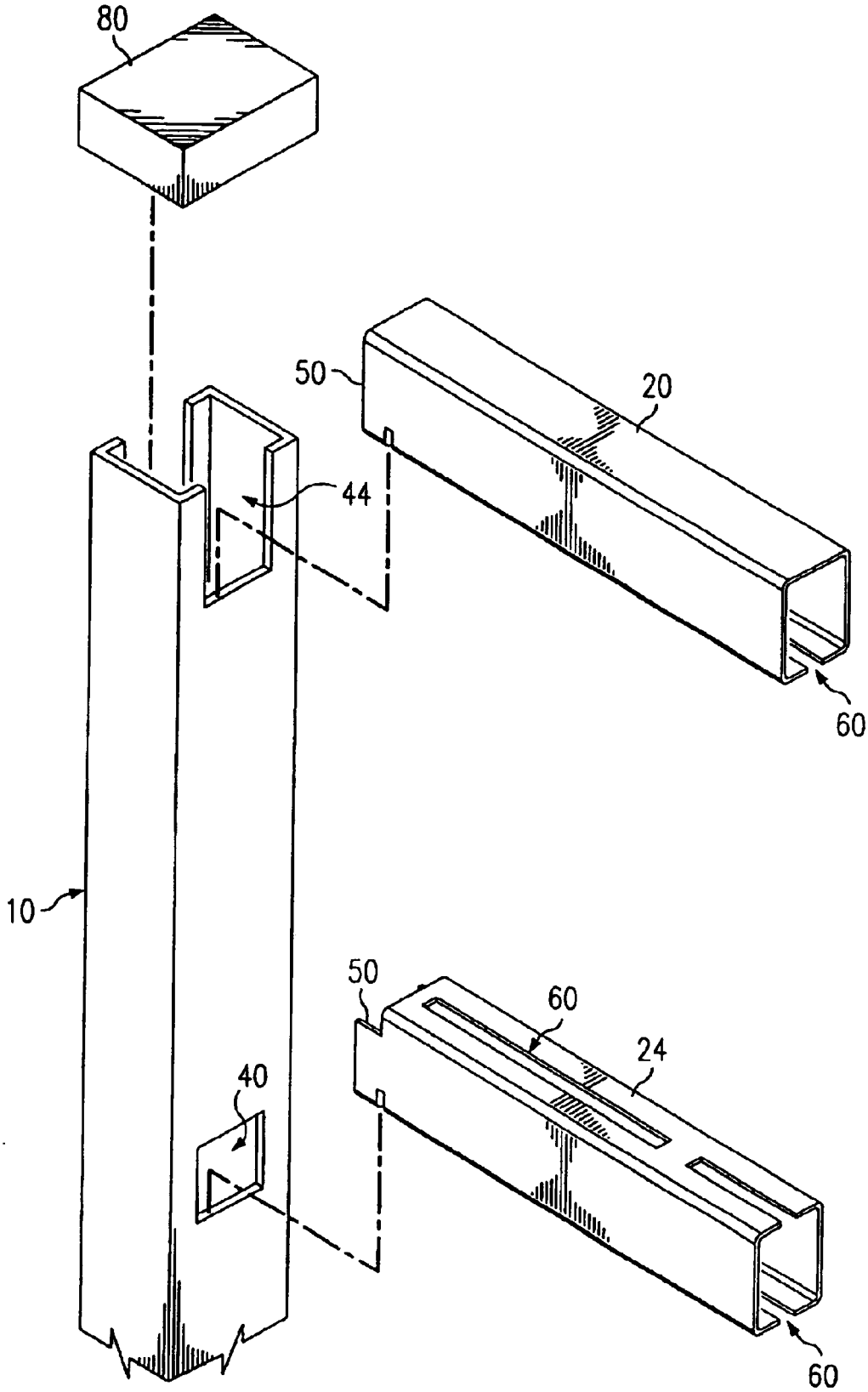
FIG. 8 illustrates a partial perspective view of a fence post and rail joining technique according to FIG. 1 and FIG. 4.

Referring to FIGS. 1, 5 and 6 it can be seen that paling member 3 is rectangular in shape when viewed in plane. Paling member 3 is elongate and can be solid or hollow with internal reinforcing ribs.

Referring to FIGS. 1, 4, and 6 post member 1 and rail members 2 can be seen coupled together.

Referring to FIGS. 1, 5, and 6 it can be seen how paling members 3 can be dropped through a center rail member 2. A bottom rail member 2 is slotted on the top edge only. A top rail member 2 is slotted on the bottom edge only and/or can have a continuous opening along the bottom edge to accommodate different paling widths.

Referring to FIG. 6, it can be seen that stiffening bars 7 are inserted into post member 1 at post opening 4 and into established rail member 2. Stiffening bars 7 straddle paling member 3. The stiffening bars project a sufficient distance out of the opposing face of post member 1 to accommodate a future rail member 2 and a paling member 3.

It should be appreciated that various other minor changes and modifications may be made to the embodiment described without departing from the spirit and scope of the invention as claimed.

What is claimed is:

1. A fence assembly comprising: a post member; a plurality of rail members; a plurality of paling members; and a plurality of stiffening bars; wherein said rail members locate in said post member; said rail members connect to said post member; said paling members connect to said rail members; and said plurality of stiffening bars pass through said post member and straddle said paling member nearest to said post member.

2. The fence assembly of claim 1 wherein said stiffening bars extend post to post.

3. The fence assembly of claim 1 wherein said post member is perpendicular to said rail member when connected.

4. The fence assembly of claim 1 wherein said paling members are perpendicular to the said rail members when installed.

5. The fence assembly of claim 1 wherein the said paling members are parallel to the said post member when connected.

6. The fence assembly of claim 1 wherein said paling members are formed from ploy vinyl chloride into rectangular hollow sections.

7. A method of constructing a fence assembly comprising:

placing a post in a surface;

locking a plurality of end projections of a rail into the post;

dropping a paling through a center rail and a bottom rail;

placing a top rail into a slot in a post top and over a paling top;

locking down said top rail into said post; and inserting a pair of stiffening bars into a post opening and into said rail so that the stiffening bars straddle the paling.

8. A fence comprising:

at least one post;

at least one rail engaged to said post;

at least one paling member engaged to said rail; and a plurality of stiffening bars disposed within said rail and said post, and disposed on opposite sides of said paling member.

9. The apparatus of claim 8 wherein said post is vertically disposed relative to a surface.

10. The apparatus of claim 8 wherein said rail is at approximate right angles to said post.

11. The apparatus of claim 8 wherein said paling member is parallel to said post.

12. The apparatus of claim 8 wherein a plurality of said paling members are coplanar.

13. The apparatus of claim 8 wherein each of said plurality of stiffening bars is adapted to fill a cavity between the paling member and an internal wall of the rail.

14. The apparatus of claim 8 wherein said rails further comprise:

a top rail containing an aperture for receiving said paling member only on the lower side of said top rail;

at least one middle rail containing apertures for receiving said paling member only on the upper side and the lower side of said middle rail; and a bottom rail containing an aperture for receiving said paling member only on the upper side of said bottom rail.

15. A fence comprising:

at least one post;

at least one rail engaged to said post;

a plurality of paling members engaged to said rail;

wherein said paling members are coplanar;

wherein a plurality of stiffening bars passes through the rail and the post and are disposed on opposite sides of a paling member.

16. The apparatus of claim 15 wherein said post is vertically disposed relative to a surface.

17. The apparatus of claim 15 wherein said rail is at approximate right angles to said post.

18. The apparatus of claim 15 wherein said paling member is parallel to said post.

19. The apparatus of claim 15 wherein said rails further comprise:

a top rail containing an aperture for receiving said paling member only on the lower side of said top rail;

at least one middle rail containing apertures for receiving said paling member only on the upper side and the lower side of said middle rail; and a bottom rail containing an aperture for receiving said paling member only on the upper side of said bottom rail.

* * * * *